United States Patent [19]

Mathe

[11] 4,095,870

[45] Jun. 20, 1978

[54] STRAIN RELIEF ADAPTER FOR AN ELECTRICAL CONNECTOR

[75] Inventor: Istvan Mathe, Cicero, Ill.

[73] Assignee: Bunker Ramo Corporation, Oak Brook, Ill.

[21] Appl. No.: 764,974

[22] Filed: Feb. 2, 1977

Related U.S. Application Data

[63] Continuation of Ser. No. 679,091, Apr. 21, 1976, abandoned, which is a continuation of Ser. No. 537,192, Dec. 30, 1974, abandoned.

[51] Int. Cl.[2] ..... H01R 13/58

[52] U.S. Cl. ..... 339/103 R; 339/75 M; 339/97 R

[58] Field of Search ..... 339/103 R, 103 M, 103 C, 339/75 M, 97 R, 97 P, 99 R

[56] References Cited

U.S. PATENT DOCUMENTS 3,879,099 4/1975 Shaffer ..... 339/107 X

*Primary Examiner*—Roy Lake

*Assistant Examiner*—DeWalden W. Jones

*Attorney, Agent, or Firm*—William Lohff; F. M. Arbuckle

[57] ABSTRACT

A strain relief adapter for providing strain relief for insulated conductors which are electrically connected to respective insulation-piercing contact portions supported in respective spaced parallel channels on opposite sides of an electrical connector comprises a pair of one-piece molded structures each of which includes a plurality of pressure members spaced to be received in the respective channels to engage and press against the electrically connected portions of the conductors, conductor clamping means in the form of a comb-shaped edge having a plurality of constricted openings for receiving respective conductors, and a force diversion member extending parallel to, but directed away from, the pressure members and the comb-shaped conductor clamp, also in the form of a comb, to receive the conductors between the teeth thereof for preventing dislocation of the conductors from the insulation-piercing contact portions in response to the application of pulling forces on the conductors.

21 Claims, 13 Drawing Figures

Fig. 7
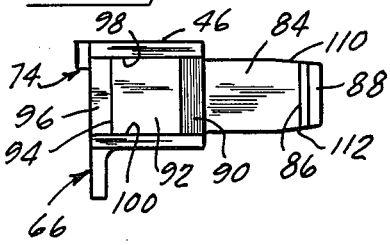
Fig. 6
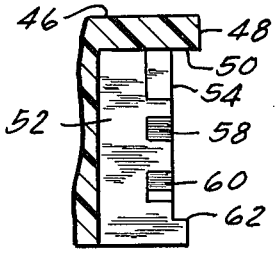
Fig. 8
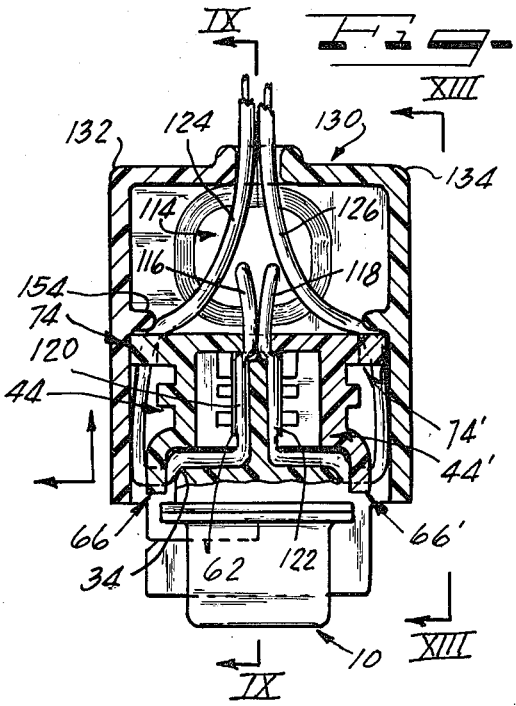
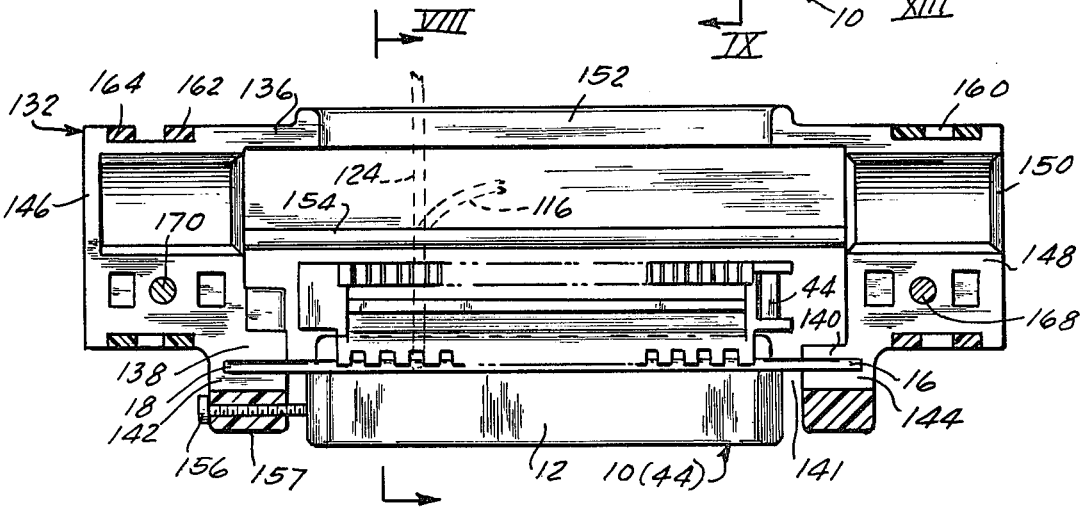
Fig. 9
Fig. 10
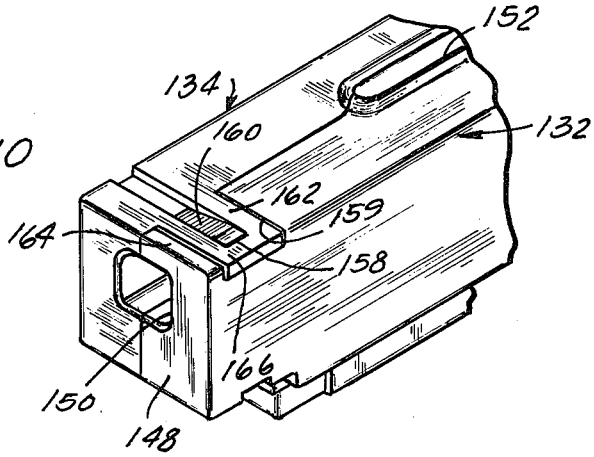

STRAIN RELIEF ADAPTER FOR AN ELECTRICAL CONNECTOR

This is a continuation, application of application Ser. No. 679,091, filed Apr. 21, 1976 which is a continuation of Ser. No. 537,192, filed Dec. 30, 1974, both now abandoned.

CROSS REFERENCE TO RELATED APPLICATION

This subject matter of this application is related to the subject matter of an application of ISTVAN MATHE and RONALD R. MAROS entitled "Hood Assembly for an Electrical Connector," Serial No. 537,087 filed December 30, 1974, now Patent No. 3,966,293.

BACKGROUND OF THE INVENTION

1. Field of the Invention

This invention relates to electrical connector apparatus, and is more particularly concerned with a strain relief adapter for an electrical connector.

2. Description of the Prior Art

In my application for United States Letters Patent entitled "Tool and Adapter for Electrical Connection Unit Using Insulation Piercing Contacts," Ser. No. 482,547, filed June 24, 1974 as a continuation of my earlier application of the same title, Ser. No. 370,037, filed June 14, 1973, I disclose strain relief apparatus for an electrical connector which employs a plurality of insertion blades which have a two-fold purpose. First of all, blades are employed as a tool for engaging and forcing insulated conductors into respective insulation-piercing contact portions of an electrical connector. Secondly, the blades are carried on a common member which also supports a comb-shaped member which receives the individual conductors between the teeth of comb to provide strain relief as the structure is snapped about the rear portion of the electrical connector. Two such adapters may be mounted on opposite sides of an elongate electrical connector and a common hood may be slid over the adapters to provide additional positive retention of the adapters.

SUMMARY OF THE INVENTION

A primary object of the invention is to provide an improved strain relief adapter which may be installed on the rear portion of an electrical connector which has already had conductors electrically connected to the contacts of the connector. Another object of the invention is to provide an improved strain relief adapter which is more suitable than prior adapters for use in connection with termination tools.

Another object of the invention is to provide an improved strain relief adapter constructed of two-identical one-piece molded structures which may be mounted on opposite sides of an electrical connector and which are interengageable with each other to clamp not only to the connector, but to each other.

Another object of the invention is to provide a strain relief adapter which provides strain relief on the incoming lead side and on the outgoing lead side of an electrical connector which constitutes a tap in a bundle of conductors.

Another object of the invention is to provide a strain relief adapter which includes an integral diversion structure for preventing dislodgement of the conductors from their electrical contacts in response to tensile forces applied on the outgoing leads.

According to the invention, a strain relief adapter for insulated conductors electrically connected to contact portions supported spaced apart by an electrical device, such as an electrical connector, comprises a plurality of pressure members spaced apart corresponding to the spacing of the contact portions for engaging and pressing against first portions of the insulated conductors in the contact area, conductor clamping means spaced from the pressure members for receiving and clamping second portions of the insulated conductors along lines parallel to the first portions of the conductors, and force diversion means spaced from the pressure members and from the conductor clamping means for receiving the conductors and preventing dislocation of the first portions in response to the application of pencil forces to the conductors.

More specifically, the invention provides a strain relief adapter for insulated conductors which are pressed into insulation-piercing contact portions supported spaced apart in respective channels in parallel rows on opposite sides of an electrical connector, the adapter comprising a pair of identical interengageable molded parts for opposite sides of the electrical connector and each of the parts including a plurality of blades for entering the respective channels and pressing against the insulation-pierced portions of the conductors, a comb-shaped edge opposite the blades having constricted openings for receiving the insulated conductors to clamp the outgoing lead portions of the conductors, and a comb-shaped member parallel to and extending away from, the blades and the constricted opening comb clamping structure for receiving the individual conductors between the teeth thereof as a means for diverting laterally and upwardly applied forces to prevent dislocation of the conductors from the insulation-piercing contact portions.

The application of pressure to the conductors by the blades provides additional strain relief in that the blades fill the channels straightening any channel barriers which were deformed during conductor insertion and creating frictional forces against the sides of the barriers as additional protection against loosening of the conductors.

BRIEF DESCRIPTION OF THE DRAWINGS

Other objects, features and advantages of the invention, its organization, construction and operation will be best understood from the following detailed description of a preferred embodiment of the invention taken in conjunction with the accompanying drawings, on which:

FIG. 6 is a partial fragmentary sectional view taken substantially along the parting line VI—VI of FIG. 5;

FIG. 7 is an end view taken in the direction VII—VII of FIGS. 3 and 4;

FIG. 8 is a sectional view, taken substantially along the line VIII—VIII of FIG. 9 illustrating a pair of the adapters of FIG. 4 mounted on an electrical connector and covered with a hood assembly which provides additional strain relief;

FIG. 9, is a complementary sectional view taken substantially along the parting line IX—IX of FIG. 8 illustrating an adapted connector mounted in one shell of the hood assembly, specifically showing the hood assembly features for providing an incoming bundle clamp and outgoing conductor distribution;

FIG. 10 is a perspective view of the hood assembly of FIGS. 8 and 9 specifically illustrating a latching structure for releasably locking the housing shells together;

DESCRIPTION OF THE PREFERRED EMBODIMENTS

Figure 1:
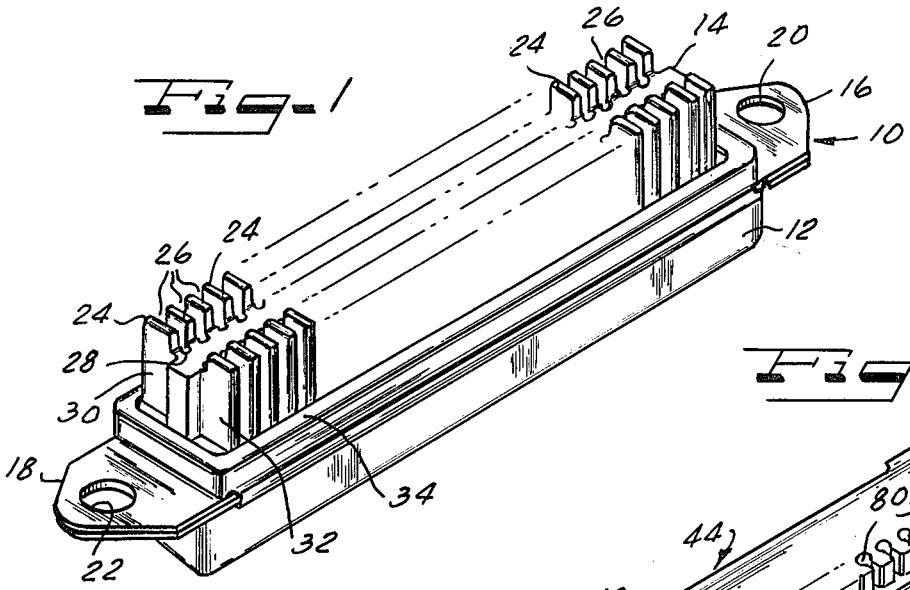
FIG. 1 is a perspective view of an elongate electrical connector which may advantageously be provided with strain relief according to the invention.
Figure 4:
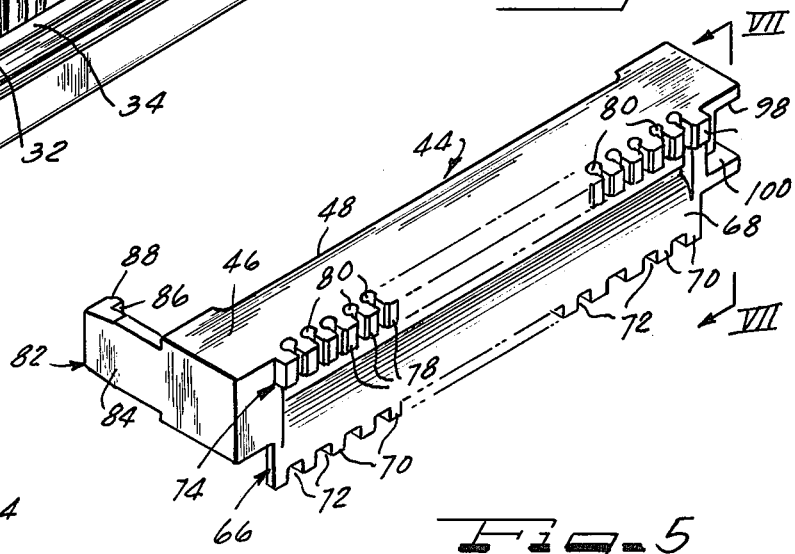
FIG. 4 is a perspective view of a strain relief adapter according to the invention, specifically illustrating the outer side and one end of the strain relief adapter.

Referring to FIG. 1, an electrical connector is generally illustrated at 10 as comprising a forward portion 12 which, as is well known in the art, is mateable with a complementary connector unit, and a rear portion 14 which carries the contact portions for connection to individual conductors of a bundle or cable. Connectors of this type may advantageously be provided with insulation-piercing contact portions, one type of which will be discussed below.

The connector 10 also comprises means for mounting the connector to a supporting device or surface, depending on its particular application, and in the particular connector illustrated in FIG. 1 a pair of flanges 16 and 18, including respective mounting holes 20 and 22 are illustrated as one type of such mounting means.

The rear portion 14 of the connector 10 is usually molded from a plastic material as a structure which includes a plurality of spaced vertical ribs 24 defining a plurality of channels 26 therebetween on each side of the connector. The inner portion of each channels 26 includes a constricted opening 28 for receiving a conductor and providing a certain amount of strain relief.

The rear portion 14 of the connector 10 includes a pair of recesses 30 and 32 at each end thereof which, as will be understood from the description below, aids in locating and aligning the strain relief adapter.

It should be mentioned here that although reference may be made to specific directions and relationships, such as vertical, horizontal, above and below, these directions and relationships are utilized for clarity only with respect to the particular orientation of the apparatus as illustrated on the drawings. It will be appreciated that these terms are only limiting in their sense of relationship with respect to each other in that an electrical connector may be oriented in an almost limitless number of positions, as is well known to those versed in this art.

Figure 2:
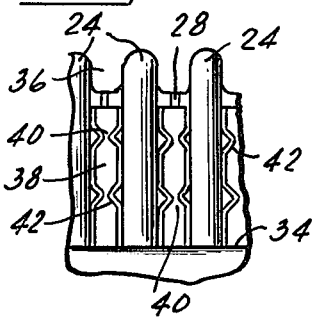
FIG. 2 is a fragmentary enlarged view of a part of the rear portion of the electrical connector of FIG. 1 specifically showing a suitable structure for an insulation-piercing contact portion.
Figure 5:
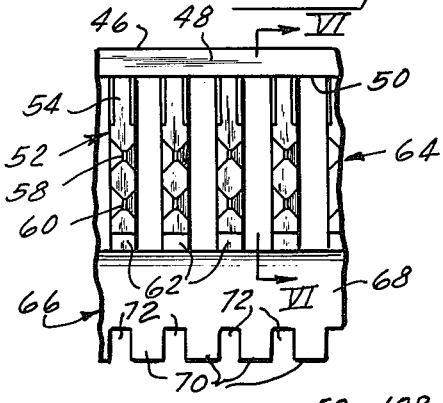
FIG. 5 is an enlarged fragmentary view of a portion of the elevation of FIG. 3 to more specifically show the structure of the pressure members and the relationship between the pressure members and the structure provided for force diversion.
Figure 3:
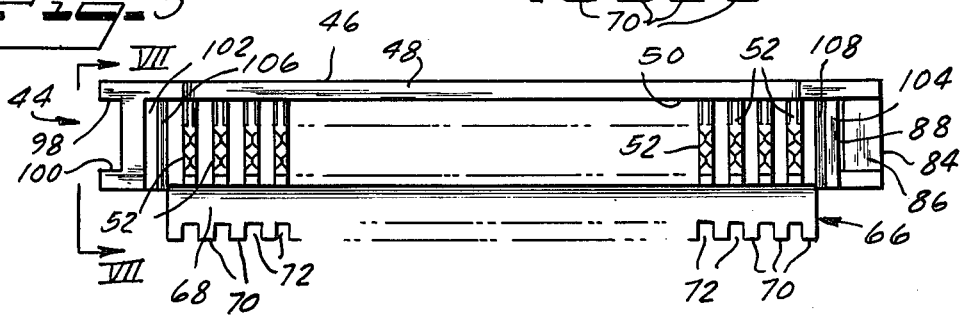
FIG. 3 is an elevation of the inner side of a strain relief adapter constructed in accordance with the present invention.

Referring to FIG. 2, an enlarged view of part of the rear portion of the connector 10 of FIG. 1 is illustrated in an enlarged view to more clearly show that the ribs 24 define channels which have insulation-piercing contact portion 38 supported therein, each of the contact portions 38 including one or more insulation-piercing notches 40 formed by a pair of opposed sharp edge portions 42. The channels 26 extend upwardly to form notches 36 to receive and have the conductors dressed therein prior to actual electrical connection to the insulation-piercing contact portions 38. Although this specific structure is illustrated herein, it is only typical of many suitable contact structures which may be utilized in an electrical connector and which may be supplemented, with respect to strain relief, by a strain relief adapter constructed in accordance with the invention.

Referring to FIGS. 3–7, a strain relief adapter constructed according to the invention is illustrated at 44 as comprising a generally rectangular, elongate element, preferably molded of plastic material, and which comprises an upper surface 46 having a shallow edge recess 48 which presses against the incoming portions of the conductors above the constricted notches 28 to increase the strain relief at the incoming portions of the conductors.

The recess 48, as can be seen in FIG. 6, is carried on a ledge member 50 which, when mounted on the connector, rests on the upper ends of the vertical ribs 24.

A plurality of pressure members, in the form of blades 52 which are similar to conductor insertion blades, are to be received in the channels to engage and press against the conductors which have already been electrically contacted by the contact portions. Each of the blades 52 comprises a first narrow portion 54 to engage the respective conductor adjacent its entry into the connector strain relief mechanism, second and third narrow portions 58 and 60 for engaging the conductor adjacent the insulation-piercing notches 40, and a spur or projection 62 which extends beyond the distal edge of the blade proper to slightly dig into the insulation of the conductor and provide additional securement within the contact portion 38. The plurality of insertion blades 52 have been given the collective reference numeral 64 and constitute a means for engaging and urging each of the conductors into the respective insulation-piercing contact portion. The vertical ribs 24 constitute barriers between the contact portions 38 which may be pushed apart by an insertion tool or over size conductors causing decreased pressure on the conductors and the possibility of decreased electrical reliability. The insertion blades 52 therefore provides several advantages including additional pressure on the conductors, realignment of the barriers in those cases where the barriers have been deformed, and filling of the barriers to provide additional frictional forces between the barriers, the contact portions and the insulated conductors via the blades 52 for a tighter and more reliable assembly.

The strain adapter 44 is also provided with a force diversion means 66 which comprises a downwardly projecting member 68 having a lower edge formed in the shape of a comb having a plurality of teeth 70 and spaces 72 between the teeth 70. It will be apparent from FIG. 5 that each of the spaces 72 is aligned with a pressure blade 52, and as such receives a conductor therein, the conductor being subsequently bent upwardly so that the conductor at least partially wraps about the force diverter.

A wire clamping means 74 is provided opposite the recess 48 and the upper portions of the blades 52 and is constituted by a comb-shaped edge having a plurality of shaped teeth which form a plurality of complementary shaped constricted openings 80. Each of the openings 80 is aligned with a respective opening 72 of the force diverter to receive and hold the outgoing portion of the conductor in a position generally parallel to the electrically contacted portion of the conductor.

A pair of strain relief adapters is utilized for providing additional strain relief on each side of the rear portion of an electricall connector. Advantageously, each of the strain relief adapters is identical to the other and asymmetrically complementary when positioned on opposite sides of the rear portion of a connector to be cooperably interengageable with respect to mounting on the connector. For this purpose, each of the strain relief adapters is provided with a releasable locking means 82 which, as can be best seen from FIGS. 4 and 7, comprises at one end of the adapter a resilient yieldable arm 8 which projects laterally from the adapter proper and which terminates in a second projection 86 extending perpendicular thereto to form a hook. The distal end of the projection 86 includes a cam surface 88 which functions in cooperation with another element to flex the arm 84 during engagement of the two adapters.

The releasable locking means 82 further comprises, at the other end of the adapter, a cam surface 90 which leads to a flat surface 92 which together form a barrier that terminates at a shoulder 94. Beyond the shoulder 94 is a recess 96, and a surface 92 also constitutes the rear surface of another recess formed by a pair of surfaces 98 and 100.

As the two adapters are moved into engagement about opposite sides of the rear portion 14 of a connector, the cam surface 88 slidably engages the cam surface 90 flexing the arm 84 until the projection 86 slides along the surface 92. The projection 86 continues to slide along the surface 92 until it passes the shoulder 94 whereupon the energy stored in the flexed arm 84 is released causing the projection 86 to snap into the recess 96 and the arm 84 to snap into the recess formed between the surfaces 92, 98 and 100.

The adapter 44 is also provided with means for positioning, aligning, and guiding the adapter with respect to the connector and with respect to the other cooperable adapter. Refering to FIGS. 1 and 3, each adapter 44 is provided with a pair of shoulders 102 and 104 respective can guide surfaces 106 and 108 to be received in the recesses 30 and 32. In addition, and as can best be seen in FIG. 7, the resilient yieldable arm 84 has upper and lower papered guide edges 110 and 112, respectively, for initially guiding the arm into the area between the surfaces 98 and 100.

Referring to FIG. 8, a pair of adapters 44 and 44' are illustrated in section as they appear when mounted on a connector 10. In FIG. 8 a bundle of conductors, which may be in the form of a cable 114, has a plurality of conductors which are electrically connected to respective insulation-piercing contacts of an electrical connector. For simplicity, only two of such conductors have been illustrated. These two conductors include an incoming or lead in portion 116 and 118, respectively, an electrically contacted or intermediate portion 120 and 122, respectively, and a lead out or outgoing portion 124 and 126, respectively. In FIG. 8 the digging in of the projection or spur 62 is apparent, as is the additional strain relief provided by the shallow recess 48 and the wire clamping means 74. Also in FIG. 8 it will be appreciated that the force diverter 66 functions to prevent dislocation of conductors from the piercing notches of the contact portions when a pulling force is applied in the direction of the arrows.

The strain relief adapted connector is provided with additional strain relief and is protected by a hood assembly in the form of a hollow housing 130 having a pair of complementary hollow shells 132 and 134, which are more specifically described below with reference to FIGS. 9-13. In FIG. 9, an adapted connector is illustrated as being mounted in the hollow housing shell 132. The housing shell 132 includes a top wall 136, a pair of spaced bottom portions 138 and 140, which define a recess through which the front portion 12 of the connector extends, a pair of portions 142 and 144 spaced from the bottom portions 138 and 140 to form slots for receiving the mounting flanges 18 and 16 of the connector 10, and a pair of end walls 146 and 148.

The end wall 148 is provided with a semi-circular recess 150 and the top wall 136 is provided with a shallow recess defined by a raised edge 152. The recesses 141, 150 and 152 are cooperable and complementary to form openings in the hollow hood assembly 130. As mentioned above, the front portion 12 of the connector 10 extends through the opening formedly the recess 141 and its complementary recess. The recess 150 and its complementary recess form an opening for receiving a bundle of conductors which may be in the form of a cable, while the recess defined by the edge 152 and its complementary recess forms an elongate narrow slot for distributing the individual conductors.

Each of the housing shells is provided with a longitudinally extending rall 154 which projects into the hollow interior of the housing at a point immediately above and adjacent the wire clamping means 74 of the strain relief adapter 44. As can be seen more clearly in FIG. 8, the rail 154 engages and presses the conductors toward the rear of the strain relief slots 80 to provide additional strain relief to the outgoing portions of the conductors.

Each of the shells is also provided with a boss 157 which has an adjustment screw 156 threaded therethrough to engage and position the connector longitudinally with respect to the housing.

The housing shells 132 and 134 are provided with a releasable latching means which performs several functions. First of all, as the shells are latched together, they clamp incoming and outgoing conductors so that additional strain relief is provided for the entire hooded assembly. Secondly, the shells are releasably held together by the releasable latching means. Although four such structures have been indicated on the drawings, only one is illustrated in detail for discussion, the others being of the same structure. The housing shell 132, for example, includes a recess 159 in which there is a shoulder 158 which develops into a ramp 160 that terminates at the parting line of the shells. The complementary shell 134 includes a pair of resilient yieldable arms 162 and 164 having a cross member 166 at the distal ends thereof which rides up the ramp 160 until passing the shoulder 158 whereupon the arms 162 and 164, and the cross member 166 snap into the recess 159.

Figure 13:
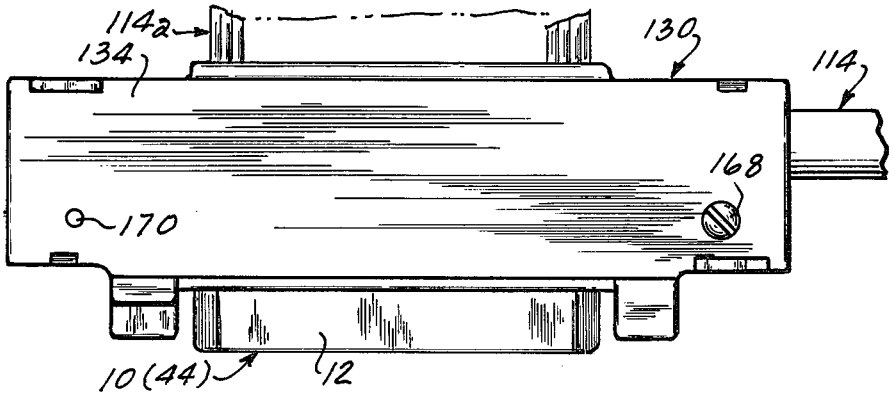
FIG. 13 is an elevational view of the apparatus of FIG. 8 as viewed in the direction XIII—XIII.

A completely assembled hooded and strain relief adapted electrical connector 10 is illustrated in FIG. 13 as receiving a cable 114 and distributing a plurality of individual conductors 114*a*. The hollow shells of the hood assembly 130 may be additionally and more securely held together by the utilization of suitable additional fastening means, such as machine screws 168 and 170.

The hood assembly and conductor receipt and distribution illustrated in FIG. 13 provides for a L-shaped conductor distribution. Different forms of T-shaped conductor distribution are illustrated in FIGS. 11 and 12.

Figure 11:
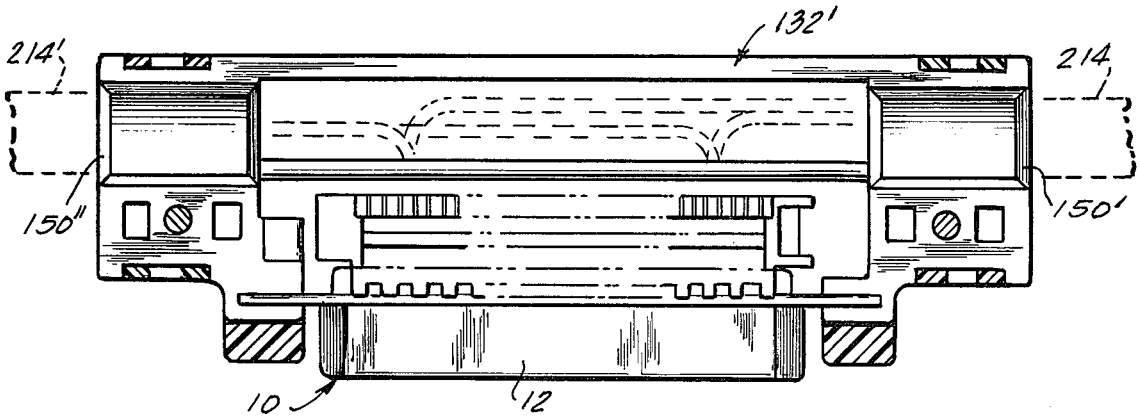
FIG. 11 is a elevation of a housing shell with an electrical connector mounted therein, specifically showing the shell adapted for receiving and clamping incoming and outgoing bundles of conductors.
Figure 12:
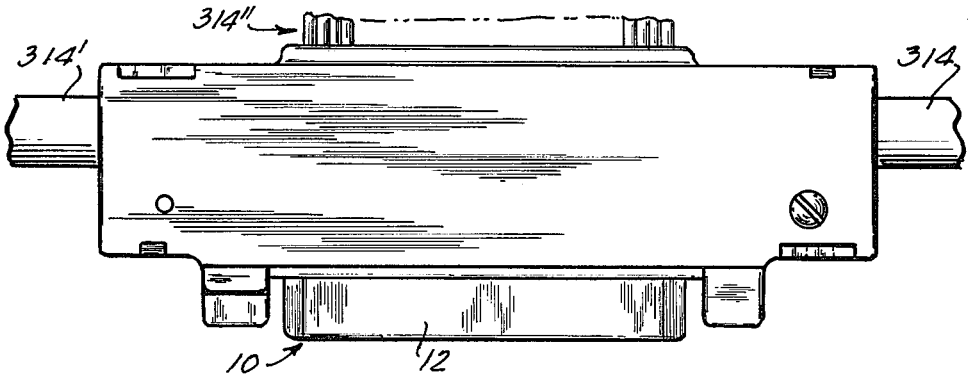
FIG. 12 is a completed housing assembly, with a connector mounted therein, similar to FIG. 11 additionally showing a narrow slot for distributing a portion of the conductors.

The hollow shells in FIGS. 11 and 12 have substantially the same structure as that previously discussed. Therefore, only distinguishing features will be dealt with in connection with the T-shaped conductor distribution arrangements.

In FIG. 11, for example, the housing 132' receives a plurality of incoming conductors in the form of a bundle or a cable 214 which are electrically tapped at the connector 12 and become outgoing conductors in the form of a bundle or cable 214. The housing shell 132', and its complementary shell, are provided with end wall openings 150' and 150'' for passing the conductors therethrough and clamping the pluralities of conductors when the hood assembly is latched together.

A combination of distributions between the structures of FIGS. 9 and 11 is illustrated in FIG. 12 wherein the adapted connector 10 receives a plurality of conductors in the bundle or cable 314 at one end of the hood assembly, passes through a number of those connectors in the form of a bundle or cable 314' at the opposite end of the assembly, and distributes the remaining number of individual conductors, as indicated at 314''. This conductor arrangement also takes into consideration that some of the conductors may be tapped and extended in a first direction, other conductors tapped and extended in a second direction, and even that further conductors may be extended through the hood assembly for ease in wire distribution without being tapped or terminated. Also, dead end terminations may be accomplished with the conductor tap and strain relief features disclosed herein without extension of the outgoing leads much beyond the strain relief provided by the wire clamping means 74, and possibly the ridge 154.

Although the present invention has been described by reference to particular illustrative embodiments thereof, many changes and modifications of the invention may become apparent to those skilled in the art without departing from the spirit and scope of the invention. It is therefore intended that the patent warranted hereon include all such changes and modifications as may reasonably and properly be included within the scope of this contribution to the art.

I claim:

1. A strain relief adapter for insulated conductors which are forced into insulation-piercing contact portions supported spaced apart by an electrical device which supports said adapter, said adapter comprising:

a plurality of pressure members spaced apart corresponding to the spacing of the insulation-piercing contact portions to engage and press against first portions of the insulated conductors;

conductor clamping means spaced from said pressure members for receiving and clamping second portions of the insulated conductors along lines parallel to the first portions of the conductors; and force diversion means spaced from said pressure members and from said conductor clamping means for receiving the conductors partially wrapped thereabout and preventing dislocation of the first portions in response to the application of tensile forces to the conductors.

2. A strain relief adapter according to claim 1, further comprising:

a projection extending from each of said pressure members to engage and slightly dig into the insulation of the respective conductor.

3. A strain relief adapter according to claim 1, comprising:

means for locking said adapter on the electrical device with the pressure members urging the conductors into the respective insulation-piercing contact portions.

4. A strain relief adapter for insulated conductors which are forced into insulation-piercing contact portions supported in respective spaced parallel channels on at least one side of an electrical connector, said adapter comprising:

a plurality of pressure members spaced to be received in respective channels to engage and press against first portions of the insulated conductors;

conductor clamping means extending parallel to said plurality of pressure members to receive and clamp second portions of the insulated conductors; and force diversion means parallel and intermediate said pressure members and said conductor clamping means along the paths of the conductors partially wrapped thereabout for receiving the conductors and preventing dislocation of the first portions from the insulation-piercing contact portions in response to the application of tensile forces to the conductors.

5. A strain relief adapter according to claim 4, wherein each of said pressure members comprises a projection extending therefrom in the direction of insertion into the respective channel for pressing into the insulation of the conductor terminated in the insulation-piercing contact supported therein.

6. A strain relief adapter according to claim 4, comprising:

adapter locking means for locking said adapter onto the electrical connector.

7. A strain relief adapter for insulated conductors which are pressed into insulation-piercing contact portions supported in respective spaced parallel channels on opposite sides of an electrical connector, said adapter comprising:

first and second elongate members, each of said elongate members being for respective sides of the electrical connector and each comprising a plurality of pressure members on one side of the elongate member spaced to be received in respective channels to engage and press against first portions of the insulated conductors, conductor clamping means on another side of the elongate member to receive and clamp second portions of the insulated conductors, and force diversion means parallel said pressure members and said conductor clamping means for receiving the conductors partially wrapped thereabout and preventing dislocation of the first portions from the insulation-piercing contact portions in response to the application of tensile forces to the conductors; and locking means for locking said first and second elongate members on the electrical connector.

8. A strain relief adapter according to claim 7, wherein said locking means comprises:

a first hook-shaped element extending from one end of said first elongate member;

a second hook-shaped element extending from one end of said second elongate member;

a first hook receiving portion at the other end of said first elongate member for releasably receiving said second hook-shaped element in snap-in engagement; and a second hook receiving portion at the other end of said second elongate member for releasably receiving said first hook-shaped element in snap-in engagement.

9. A strain relief adapter for insulated conductors which are pressed into insulation-piercing contact portions supported spaced apart in parallel rows on opposite sides of an electrical connector, said adapter comprising:

a pair of identical interengageable parts for opposite sides of the electrical connector, each of said parts including first means for engaging and urging each of the conductors on the respective side of the connector into the respective insulation-piercing contact portion, second means spaced from said first means for receiving the conductors in a partial wrap thereabout to prevent tensile forces on the conductors from dislodging them from the contact portions, third means spaced from said first and second means for clamping the conductors, and first and second complementary shaped portions for cooperable snap-in retention of said first portion in said second portion of the other part.

10. A strain relief adapter according to claim 9, wherein said second means comprises a comb-shaped portion for receiving the conductors between the teeth thereof.

11. A strain relief adapter according to claim 9, wherein said first means comprises:

a plurality of members for engaging and pressing against respective insulated conductors, each of said members including a blade having a forward end, and a projection extending beyond said forward end in the direction of the respective conductor to slightly indent the insulation of the conductor.

12. A strain relief adapter according to claim 11, wherein said second means comprises:

a comb-shaped portion having a plurality of teeth defining notches aligned with respective blades of said first means.

13. A strain relief adapter according to claim 11, wherein said first means comprises a wall extending transversely across and projecting beyond said blades, said wall partially covering the rear end of the electrical connector, said wall including a recess in one edge which is cooperable with the like recess of the other adapter part to form a slot for receiving incoming portions of the conductors, and said third means comprises a plurality of shaped teeth in the opposite edge of said wall forming constricted entry slots therebetween for receiving outgoing portions of respective conductors.

14. A strain relief adapter according to claim 9, wherein: said first complementary shaped portion comprises a hook-shaped member including a first projection extending from the respective part, and a second projection extending substantially perpendicular to said first projection; and said second complementary shaped portion comprises a hook-engaging portion including first means defining a first recess for receiving said first projection, and second means defining a second recess for receiving said second projection.

15. A strain relief adapter according to claim 14, wherein:

said second complementary shaped portion further includes third means defining an interference barrier to the movement of said second projection into the second recess; and said first projection is resiliently yieldable to permit passage of said second projection beyond said third means for snap-in reception of said second projection by the second recess.

16. A strain relief adapter according to claim 15, wherein: said second projection and said third means each comprise cam surfaces which are slidably engageable to cause yielding of said first projection.

17. A strain relief adapter for an electrical connector which has front and rear portions with insulation-piercing contact portions supported by the connector and accessible in rows on at least one side of the rear portion of the connector, the contact portions piercing the insulation of and electrically contacting respective conductors between incoming and outgoing portions of the conductors, said strain relief adapter comprising:

locking means for locking said adapter to the electrical connector: pressure means for engaging and applying pressure to the conductors mounted in the insulation-piercing contact portions adjacent the incoming portions;

clamping means clamping the insulated conductors adjacent the outgoing portions at points spaced from the contact portions;

force diversion means located between said pressure means and said clamping means with respect to the incoming-outgoing path of the conductors for receiving and reversing the direction of the conductors to provide the outgoing portions parallel to the incoming portions and to prevent dislocation of the conductors from the insulation-piercing contacts in response to the application of tensile forces thereto.

18. A strain relief adapter for insulated conductors which are forced into and electrically in contact with respective insulation-piercing contact portions supported in respective spaced parallel channels on at least one side of an electrical connector, said adapter comprising:

a one-piece molded structure which includes a plurality of pressure members spaced to be received in respective channels to engage and press against first portions of the insulated conductors, conductor clamping means extending parallel to said plurality of pressure members to receive and clamp second portions of the insulated conductors, and force diversion means disposed parallel to and intermediate said pressure members and said conductor clamping means along the paths of the conductors and force diversion means projecting generally away from said pressure members and said clamping means to receive the conductors partially wrapped thereabout and prevent dislocation of the first portions from the respective insulation-piercing contact portions in response to the application of tensile forces to the conductors.

19. The strain relief adapter of claim 1, wherein said force diversion means comprises means defining a tortuous path for each of the conductors at locations along the conductors between said pressure members and said conductor clamping means.

20. The strain relief adapter of claim 1, wherein said adapter comprises a first surface extending between said pressure members and said force diversion means transversely of the direction of said pressure members, a second surface extending along said force diversion means perpendicular to said first surface, said first and second surfaces engaging and pressing the conductors against the electrical device adjacent said force diversion means and cooperable with said force diversion means to define a tortuous path for each of the conductors at respective locations between said pressure members and said conductor clamping means.

21. The strain relief adapter of claim 1, wherein each conductor traverses a reversing path between said pressure members and said conductor clamping means, and wherein said force diversion means comprises a comb-shaped structure having conductor-receiving slots therein opening generally in the direction opposite to the direction of conductor reversal.

* * * * *